US005305954A

United States Patent [19]

Abel

[11] Patent Number: 5,305,954

[45] Date of Patent: Apr. 26, 1994

[54] HEATING SYSTEMS

[76] Inventor: Gunther Abel, 8212 Alpine Way, Whistler, British Columbia, Canada, V0N 1B0

[21] Appl. No.: 16,466

[22] Filed: Feb. 11, 1993

[51] Int. Cl.[5] ..... F24B 7/00

[52] U.S. Cl. ..... 237/55; 122/20 B; 176/5.3

[58] Field of Search ..... 237/54, 55; 136/101, 136/513, 514, 26; 122/7 R, 20 B, 13 R, 16

[56] References Cited

U.S. PATENT DOCUMENTS 2,307,600 1/1943 Munters et al. ..... 126/514 X
4,126,118 11/1978 Haynes ..... 126/513 X
4,178,907 12/1979 Sweat, Jr. ..... 237/55 X
4,461,242 7/1984 Black ..... 126/101 X
4,466,419 8/1984 Syme ..... 126/26 X
4,479,605 10/1984 Billote et al. ..... 122/17 X
4,779,795 10/1988 Winmill ..... 126/101 X

*Primary Examiner*—William E. Tapolcai
*Attorney, Agent, or Firm*—Brian M. Long

[57] ABSTRACT

A heating system comprises an oven located above a solid fuel stove, a chimney for receiving combustion gases from the solid fuel stove, and a heat exchanger in the chimney for transferring heat from the combustion gases to a flow of water. A heat exchange passage adjacent a water tank receives combustion gases from the stove and transfers heat from the combustion gases to water in the water tank. A damper is adjustable for controlling the flow of the combustion gases to the chimney and to the heat exchange passage.

9 Claims, 5 Drawing Sheets

HEATING SYSTEMS

BACKGROUND OF THE INVENTION

1. Field of the Invention

The present invention relates to heating systems and, more particularly, to systems for heating dwellings and other buildings, and incorporating a solid fuel stove.

2. Description of Related Art

Stoves of numerous different types are presently in use, and have been utilized in the past, for heating buildings and also for cooking purposes, and it has also been well known to combine a solid fuel stove with an oven for this purpose and for cooking.

It is also well known to employ the heat from a solid fuel stove to provide a supply of hot water, in addition to heating a room.

It is usual to provide a wood stove with a chimney and with a damper for controlling the flow of combustion gases through the chimney. When the fire is first lit, the damper is opened to provide a good flow of air through the stove and up the chimney, in order to facilitate and encourage combustion of fuel. When combustion has been well established, the damper is then partially or fully closed, to reduce the flow of air into the stove and the flow of combustion gases from the stove.

SUMMARY OF THE INVENTION

It is an object of the present invention to provide a novel and improved heating system in which the flow of the combustion gases can be controlled so as to facilitate initial combustion in a fuelled stove and, once combustion has been established, to direct the combustion gases through a different passage for heating water.

According to the present invention, a heating system comprises a solid fuel stove, an oven located above the solid fuel stove, and a chimney for receiving combustion gases from the solid fuel stove. A heat exchanger is provided in the chimney for transferring heat from the combustion gases to a flow of water. The heating system also has a water tank with a heat exchange passage adjacent the water tank for receiving combustion gases from the stove and transferring heat from the combustion gases to the water in the water tank, and a damper which is adjustable for controlling the flow of the combustion gases to the chimney and to the heat exchange passage.

With the present system the combustion gases can be directed, by means of the damper, so as to flow through the chimney when it is desired to initiate and to increase combustion of fuel in the solid fuel stove.

At other times, the damper can be adjusted so as to reduce the flow of combustion gases through the chimney, and simultaneously to increase the flow of combustion gases through the heat exchange passage, for the purpose of heating the water in the water tank.

In a preferred embodiment of the invention, a combustion gas chamber is provided beneath the oven for receiving combustion gases from the stove and thereby heating the oven.

For periods when the solid fuel stove is not in use, an auxiliary electric heater may be employed.

BRIEF DESCRIPTION OF THE DRAWINGS

Further features, advantages and objects of the present invention will be more readily understood from the following description thereof, when taken in conjunction with the accompanying drawings, in which.

DESCRIPTION OF THE PREFERRED EMBODIMENTS

Figure 1:
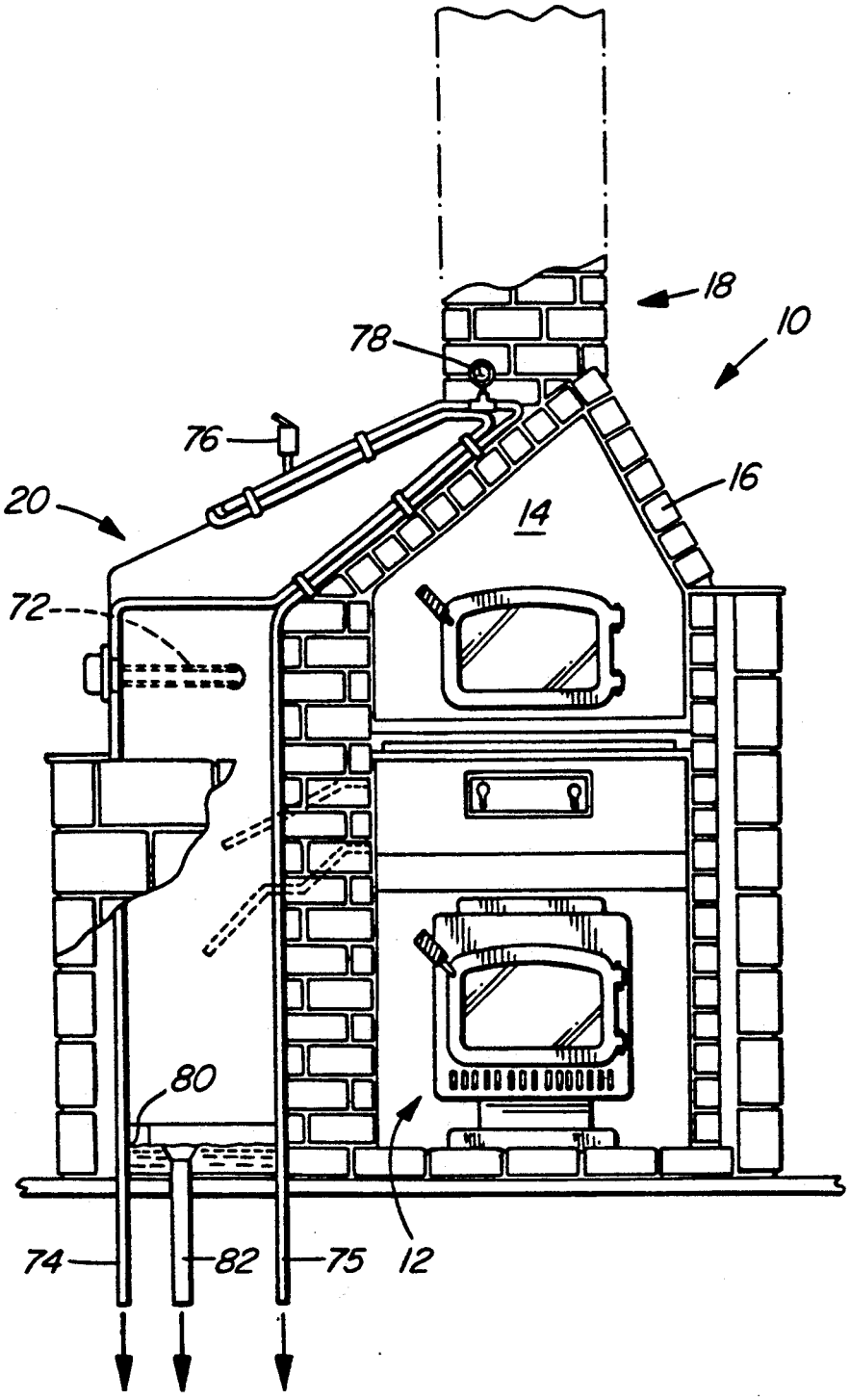
FIG. 1 shows a view in front elevation of a heating system according to the present invention.

FIG. 1 shows a heating system indicated generally by reference numeral 10, which has a solid fuel stove indicated generally by reference numeral 12 located beneath an oven 14. The stove 12 and the oven 14 are imbedded in brickwork 16 and are located beneath a chimney indicated generally by reference numeral 18.

At one side of the brickwork 16, there is provided a hot water tank indicated generally by reference numeral 20.

Figure 3:
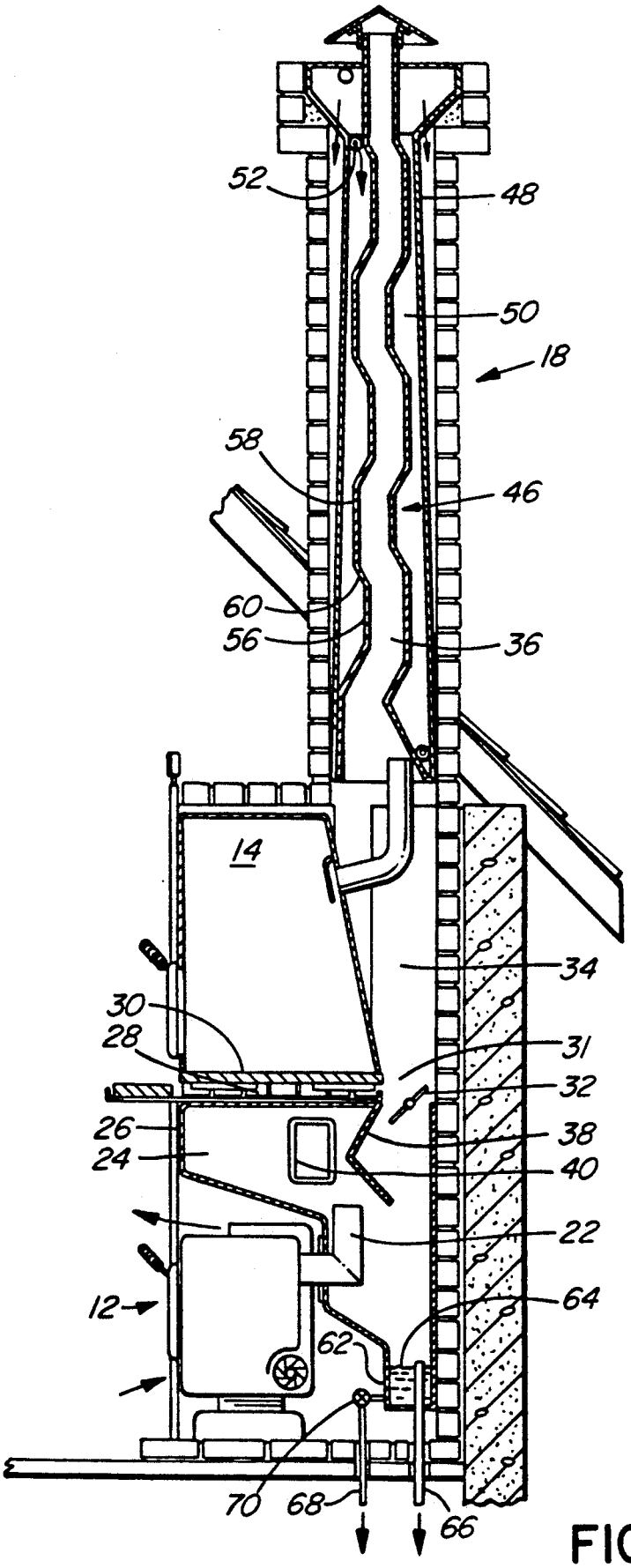
FIG. 3 shows a view taken in vertical cross-section through the heating system of FIG. 1.

Referring now to FIG. 3, the stove 12 has a combustion gas outlet pipe 22 which opens into a combustion gas chamber 24 extending above the stove 12 and below the oven 14. The combustion gas chamber 24 is defined by a sheet metal casing 26, the top of which supports a layer of fire bricks 28 on which there is mounted an auxiliary electrical heater 30, located beneath the underside of the oven 14.

The top of the metal casing 26 is formed with an outlet opening 31, controlled by a damper 32 and communicating with a chamber 34 at the rear of the oven 14. The top of the chamber 34 opens into a flue 36 of the chimney 18.

The casing 26 is also provided with an angular baffle 38, which extends downwardly from the opening 31 past a further opening 40, which is formed in a side wall of the casing 26.

Figure 2:
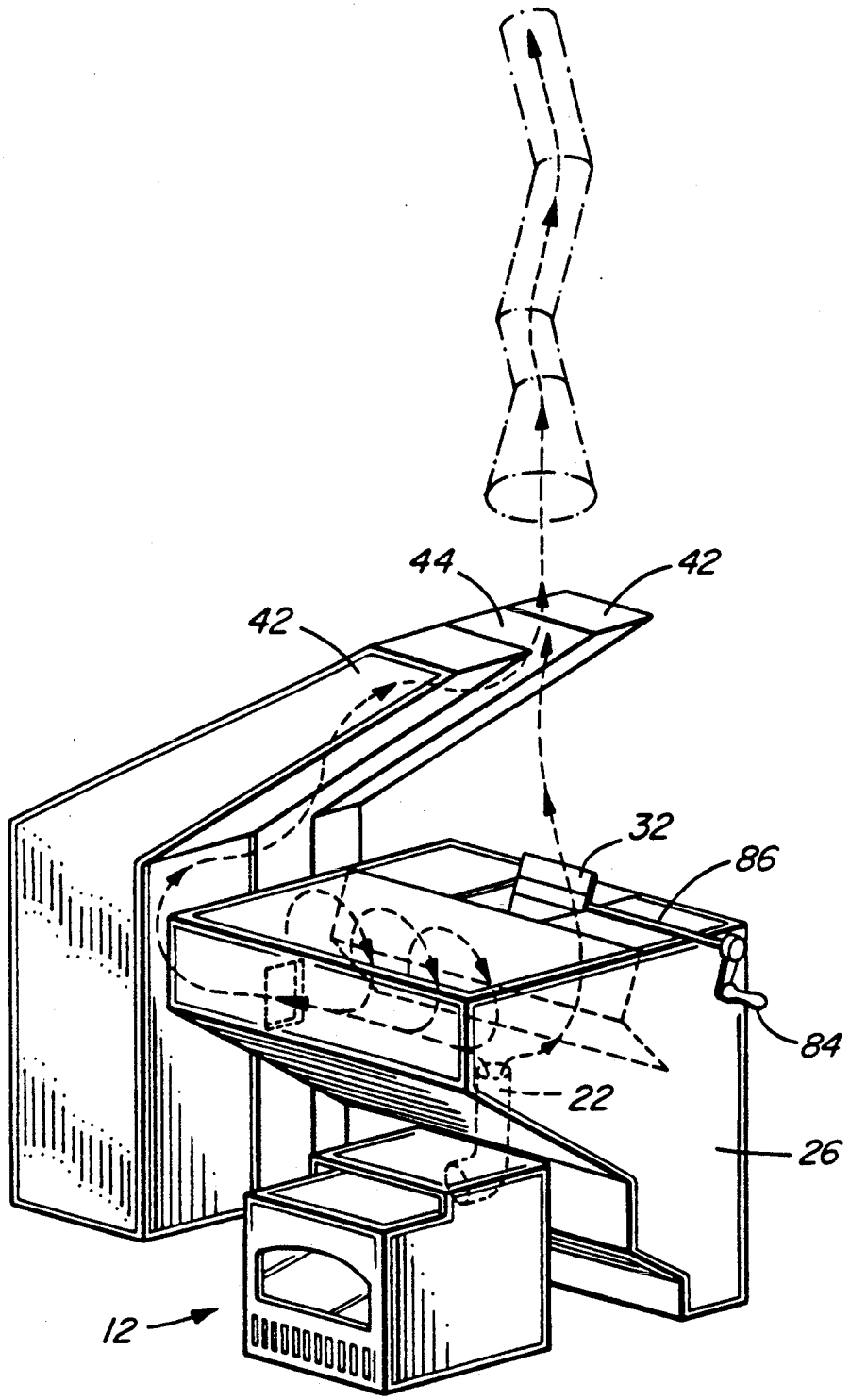
FIG. 2 shows a diagrammatic view, partially broken away, of various parts of the heating system of FIG. 1 in perspective.

As shown in FIG. 2, the water tank 20 is in two parts, which include parallel, laterally spaced and upwardly inclined tank portions 42. A heat exchange passage 44 extends between these two water tank portions 42 and communicates with the opening 40 in the side wall of the metal casing 26, so that combustion gas from the stove 12, flowing out through the opening 40, can flow upwardly through this heat exchange passage 44, as shown by a broken line and arrows in FIG. 2. Before exiting the combustion gas chamber 24 through the opening 40, this combustion gas swirls around in the upper portion of the combustion gas chamber 24, beneath the oven 14, so as to promote heating of the fire bricks 28 by the combustion gases.

Figure 4:
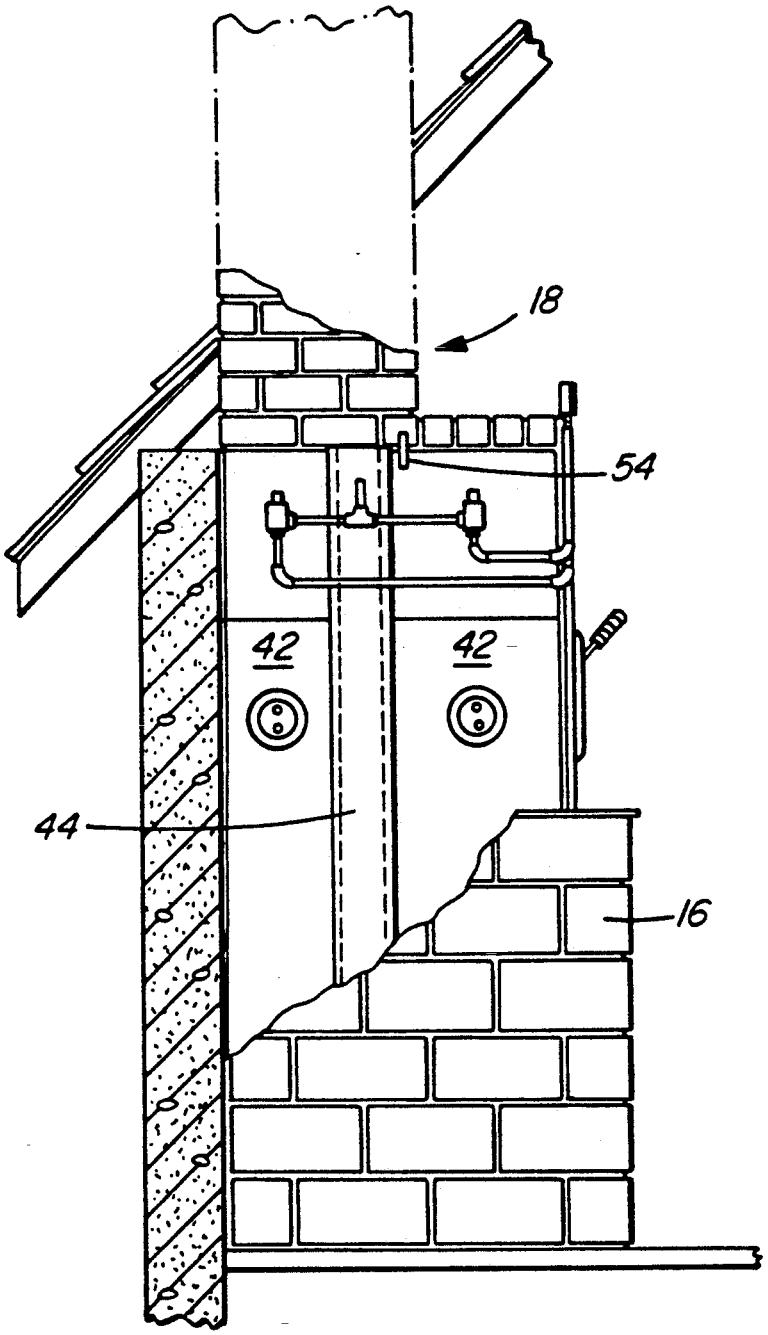
FIG. 4 shows a side view, partially broken-away, of the heating system of FIG. 1.

The flue 36 is defined by a meander-shaped metal pipe, which is indicated generally by reference numeral 46 and which is surrounded by an upwardly convergent metal jacket 48, which with the tube 46 defines a passage 50 for the flow of water in a downward direction around the flue 36. The water is supplied to the passage 50 from a water supply pipe 52 at the top of the passage 50 and, at the bottom of the passage, the water flows through an outlet pipe 54 (FIG. 4) into the water tank 20.

The pipe 46 is formed of a plurality of first vertical cylindrical portions 56, a plurality of second vertical cylindrical portions 58 which are laterally offset from the first cylindrical portions 56, and inclined cylindrical portions 60 connecting the first and second portions 56 and 58. The resulting meander shape of the flue 46 slows the outflow of the combustion gases through the flue, and thus encourages condensation of volatile substances from the combustion gases onto the inner surface of the pipe 46. These condensates then flow downwardly along the flue and past the rear of the oven 14 and through the casing opening 30 into the interior of the metal casing 26.

A bottom portion of the metal casing 26 is shaped to form a condensate collection receptacle 62 for holding this condensate. A body of water 64 may be provided in the receptacle 62, with an overflow outlet pipe 66 and with a drainage pipe 68, controlled by a cock 70.

Referring again to FIG. 1, it will be seen that the water tank 20 is provided with an electric immersion heater 72, which is useful for heating the water in the tank 70 when the stove 12 is not in use.

The water tank 20 is also provided with water outlet pipes 74 and 75, a pressure relief valve 76 and a pressure gauge 78.

The heat exchange passage 44 between the water tank portions 42 may be provided with a meander-shaped pipe (not shown), similar to the pipe 46, for promoting heat exchange with the water and the condensation of volatile substances from the combustion gases, and may be provided at its bottom with a receptacle 80 for collecting these condensates, the receptacle 80 being provided with an overflow pipe 82.

The adjustment of the damper 32 for controlling the flow of combustion gases through the chimney 18 may be effected by means of a handle 84 (FIG. 2) for rotating a shaft 86 carrying the damper 32.

Figure 5:
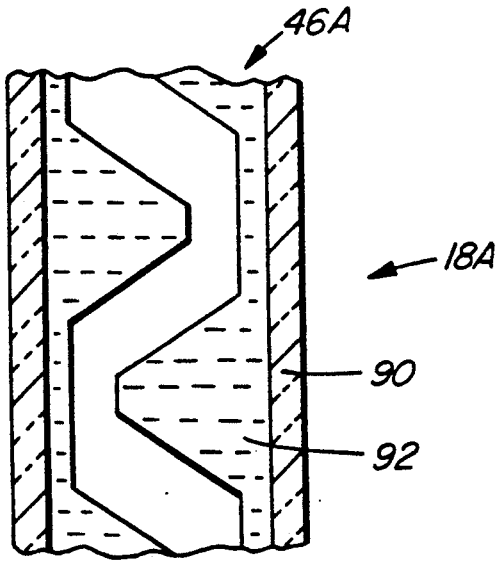
FIGS. 5, 6 and 7 show broken-away views in cross-section of parts of modifications of the chimney of the heating system of FIG. 1.

FIG. 5 shows a modification of the chimney 18, which is indicated generally by reference numeral 18A and which, like the chimney, has an outer jacket 90 of heat-insulating material which, together with the flue 46A, defines an intermediate space 92 containing a flowing or stationary cooling fluid around the flue 46A.

Figure 6:
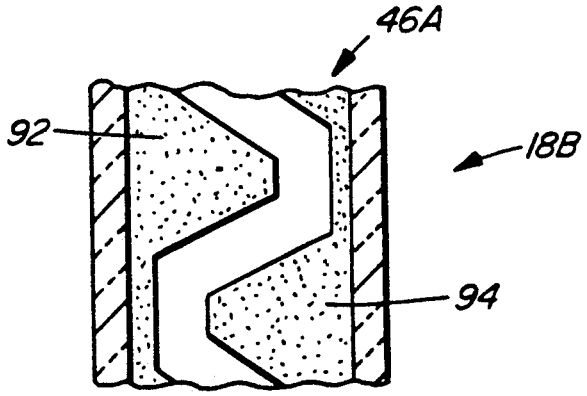

FIG. 6 shows a chimney 18B which is similar to the chimney 18A except that in the case of the chimney 18B, the intermediate space 92 contains a heat insulating material 94.

Figure 7:
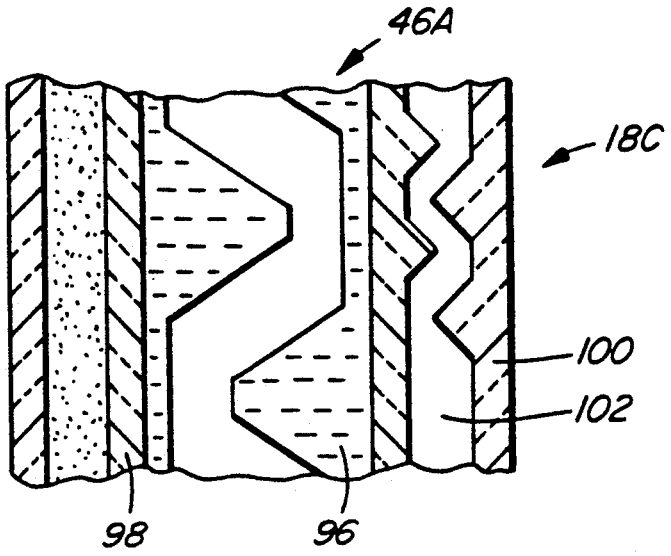

FIG. 7 shows a chimney 18C which comprises the meander shaped flue 46A, a space 96 extending around the flue 46A and containing a cooling or heating fluid, an intermediate jacket 98 of heat-insulating material surrounding the space 96, an outer jacket 100 of heat insulating material and a second meander-shaped flue 102 between the jackets 98 and 100.

As it will be appreciated by those skilled in the art, various modifications may be made in the above described embodiment of the invention, and accordingly the invention may be varied within the scope of the appended claims.

I claim:

1. A heating system, comprising:

a solid fuel stove;

a combustion gas chamber at the exterior of said stove for receiving combustion gases from said stove;

a chimney located above said combustion gas chamber, said chimney having a flue for the outflow of the combustion gases;

an outlet opening located at the top of said combustion gas chamber and provided with a damper for controlling the flow of the combustion gas upwardly through said opening;

a water tank;

a heat exchange passage extending adjacent said water tank and communicating with said flue;

second opening located at one side of said combustion gas chamber and communicating with said heat exchange passage for the outflow of the combustion gas from said combustion gas chamber; and an oven located at the top of said combustion gas chamber so as to be heated by the combustion gas therein.

2. A heating system as claimed in claim 1, including an auxiliary heater for heating said oven when said stove is not in use.

3. A heating system as claimed in claim 1, wherein said flue has a meander shape, a metal jacket around said flue defines therewith a water flow passage, and said water flow passage has a water inlet and a water outlet, whereby cooling of the combustion gases and the formation of condensate therefrom are promoted by heat exchange.

4. A heating system as claimed in claim 3, further comprising a condensate collection receptacle in said combustion gas chamber for collecting the condensate from said flue.

5. A heating system as claimed in claim 3, wherein said flue comprises a plurality of first and second vertical portions which are laterally off-set from one another and a plurality of inclined portions connecting said first and second vertical portions.

6. A heating system as claimed in claim 1, wherein said stove, said oven and said combustion gas chamber are embedded in masonry.

7. A heating system as claimed in claim 1, further comprising a condensate collection receptacle beneath said heat exchange passage for collecting condensate from the combustion gases.

8. A heating system as claimed in claim 1, wherein said heat exchange passage extends between spaced-apart-portions of said water tank.

9. A heating system as claimed in claim 7, further comprising an electric immersion heater in said water tank.

* * * * *